United States Patent [19]

Hargrove

[11] 4,050,491

[45] Sept. 27, 1977

[54] STORAGE BAG FOR USE WITH A STUDENTS CHAIR-DESK

[76] Inventor: Wilma Rae Hargrove, 1132 Livingston, Hurst, Tex. 76053

[21] Appl. No.: 698,193

[22] Filed: June 21, 1976

[51] Int. Cl.[2] ..... A45C 3/02

[52] U.S. Cl. ..... 150/1.6; 297/188

[58] Field of Search ..... 297/188, 190, 191; 150/1, 1.6, 12; 190/1, 60

[56] References Cited

U.S. PATENT DOCUMENTS

| | | | |
|---|---|---|---|
| 1,521,897 | 1/1925 | Martin | 150/1.6 X |
| 2,040,559 | 5/1936 | Luttrell | 150/1 |
| 2,909,215 | 10/1959 | Mitchell | 297/188 X |
| 3,125,372 | 3/1964 | Rose | 297/188 |

*Primary Examiner*—Donald F. Norton
*Attorney, Agent, or Firm*—H. D. Messner

[57] ABSTRACT

The present invention relates to a cloth bag for storing a younger student's school supplies; i.e., crayons, such items to be carried by the student from classroom to home and vice versa so that the bag of the present invention contemplates use of a strap attached to the top thereof. Within the school room, the bag is used in conjunction with a desk-chair which includes a chair having a seat and a back while the desk includes a planar writing board attached to any upright column located near the front edge of the chair. The bag can be hung at one side of the chair using end of a rod also located so the top of the bag is adjacent to the strap. The rod length is slightly longer than the seat depth. Result: the bag can be wedged between support members of the desk-chair, but easily "unwedged" for transport of the bag (and contents) to another location without disassembly.

6 Claims, 3 Drawing Figures

STORAGE BAG FOR USE WITH A STUDENTS CHAIR-DESK

FIELD OF THE INVENTION

This invention relates to a detachable storage bag for storing school supplies for students who sit in chair-desks in school districts which do not supply student desks with semi-permanent storing area for storage of individual student's school needs.

BACKGROUND OF THE INVENTION

Many of today's school districts are financially hard-pressed. Capital expenditures such as for student desks, especially for yonger students, say in ages 4–14 years of age, are often minimal. If desks are available, they often are shared by several students at different times during the day. For example, one student might use the desk from 8:00–10:00 a.m.; another from 10:00–11:30 a.m., and so forth. In such circumstances, individual storing areas for student school supplies, namely, crayons, scissors, glue, pencils, and the like are, more likely than not, not available.

SUMMARY OF THE INVENTION

Present invention contemplates a cloth bag made of denim material or the like for storing younger students' school supplies, say 4–14 years of age, for use in conjunction with a desk-chair does not have semipermanent storage space.

The items to be stored include crayons, scissors, glue, pencils and the like, and such items are adapted to be carried within the stow bag by the student from class to class or home to class as required s by a strap at the top of the bag as well as being easily attachable to the desk-chair by means of a rod attached also along the top of the bag adjacent the carrying strap. Preferably, the bag is for use in conjunction with a desk-chair, which includes a chair having a seat and a back and a desk with a planar writing board attached at one end of an upright which in turn is attached near the front edge of the chair. The column support is co-planar with a vertical-extending back-bracing post which extends from a back edge of the chair. Since the rod length is always greater than the span between the co-planar back brace post and the support column for the desk, the ends of the rod can be easily wedged therebetween so that the bag hangs at the one side of the chair.

The bag itself comprises a double fold of material formed with minimum stitching operations and including first and second fold lines integrally formed at the top and bottom horizontal edges of the bag. These fold lines divide the bag into single folds comprising a front panel and a back panel. A horizontal attachment line is also provided by stitching one end of the sheet of material near the top fold line. Such line permanently attaches the front and back panels together as well as divide the front panel into two subpanels: a subpanel above the attaching line, which is called a bag-support subpanel and an article-carrying storage subpanel below that line. The bag-carrying subpanel is horizontally closed betwen the first top fold line and the attachment line, but is open along vertical sides thereof to allow it to receive the rod of wood or the like by which the bag can be suspended at one side of the desk. Of course, for that reason the rod must be long enough to span the distance between the upright column supporting the desk and the back brace post of the chair, as previously mentioned. The article-carrying subpanel is open, on the other hand, at its top in the vicinity of the attachment line, but closed along its vertical side edges as well as along its bottom foldline to form a repository for the student's school supplies. The strap may also be formed of material like denim and has ends attached to the bag-carrying subpanel. Its length is sufficient to allow the student to tote the bag, using his shoulder for support, whereby he or she can carry the bag from class to class, home to class, etc., without the need to disassemble the bag and remove contents from the article-carrying subpanel. Result: a low-cost bag for students' school supplies is provided, but such bag being easily transported by young students, say 4–14 years of age, from class to class or from home to class without disassembly.

OBJECT OF THE INVENTION

An object of the present invention is the provision of a novel stow-bag for younger students' school needs, say ages 4 –14 years, such bag primarily being used in conjunction with a desk-chair in poor school districts which have no permanent storage area associated therewith.

These and other objects, advantages and attributes of the invention will become more apparent from the following detailed description of preferred embodiment of the invention in which the following drawings from an intricate part.

DETAILED DESCRIPTION OF THE DRAWING

DETAILED DESCRIPTION OF THE INVENTION

Figure 1:
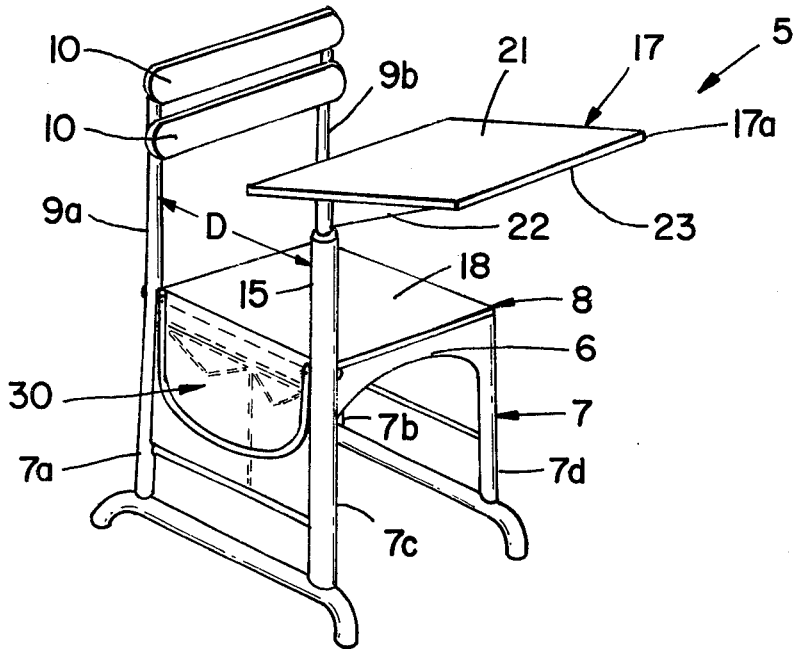
FIG. 1 is a perspective view of a preferred embodiment of the present invention and showing a stow-bag attached between a rear back-brace post in an upright support column of a chair-desk.

Reference should now be made to the drawings, in particular FIG. 1, in which a chair-desk 5 for younger student is depicted. Note that the chair-desk 5 includes a box-like base 6 from which four upright legs generally indicated at 7 extend forming a conventional chair 8. Rear legs 7*a* and 7*b* are attached to the base 6 and include upright back posts 9*a* and 9*b* which support back 10 of the chair 8. Forward legs 7*c* and 7*d* are of a different height: left leg 7*c* (as viewed) includes a support column 15 at its upper end to which is attached desk 17 well above seat 18 of the chair 8, while forward right leg 7*d* of the chair 8 is the shorter of the two and terminates at the forward edge of the seat 18. The leg 7*c* is also more rigid than its counterpart leg 7*d*: it is larger in diameter than the other leg to form a rigid support base for the column 15 previously mentioned. Desk 17 includes a planar board 17*a* having writing surface 21 on one side, but no storage area on the other side. Attachment is via cantilevered brace 22. The surface 21 is slightly canted to allow correct writing position for the student. Note again that no storage area within desk 17 for the usual student supplies, i.e., glue, scissors and the like, is provided. That is, underside surface 23 of desk 17 is not provided with a receptacle or strorage area, which may be common to other chair-desk arrangements. Reason: poor districts often use cheaper models to save on capital expenditures.

In order to provide a portable storage bag for a student's supplies, the present invention includes a cloth-made stow-bag 30 to be positioned at one side of chair-desk 10 say between backpost 9a of rear leg 7a and support column 15 of forward leg 7c.

Figure 2:
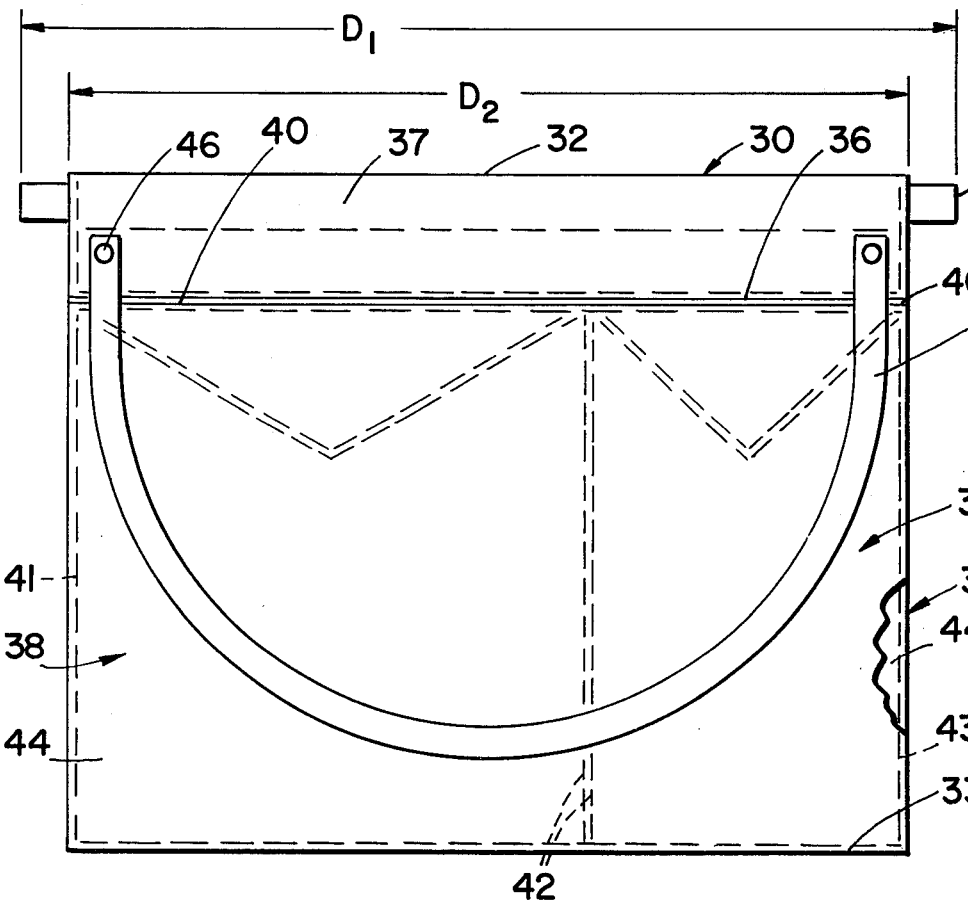
FIG. 2 is a front elevation partially cutaway from the stow-bag of FIG. 1.

FIG. 2 depicts the stow-bag 30 in more detail.

Briefly, the bag 30 is manufactured from denim cloth, with a minimum of stiching operations being required, for the purpose of allowing storing of a younger student's school supplies: crayons, scissors, glue, pencils and the like at the desk-chair of FIG. 1.

It is also contemplated that such items are to be carried by the student from classroom to home and vice versa. Thus, the bag of the present invention contemplates use of a strap 31 to the top of the bag 30.

The bag itself comprises a double fold of material formed with minimum stitching operation and including first and second foldlines 32 and 33 integrally formed at the top and bottom horizontal edges of the bag. These fold lines divide the bag into single layers comprising a front panel 34 and a back panel 35. A horizontal attachment line 36 is also provided by stitching one end of the sheet of material near the top foldline 32. Such line permanently attaches the front and rear panels together as well as divide the front panel 34 into two subpanels: a subpanel 37 above the attachment line 36, which is called a bag-support subpanel and an article-carrying storage subpanel 38 below that line. The bag-carrying subpanel 37 is horizontally closed between the first top foldline 32 and the attachment line 36, but is open along vertical sides thereof to form a repository for a rod 39 formed of wood or metal and the like, by which the bag can be suspended at the side of the desk-chair, as before mentioned. Of course, for that reason, the rod 39 must be long enough to span the distance between the upright column support of the desk and the back brace post of the chair, also as previously mentioned.

The article-forming subpanel 38 is not open along its sides nor along its bottom edge (adjacent to the second foldline 33). Instead at its top (in the vicinity of attachment line 36) it is open at entryways 40 to allow egress of a student's hand, vis-a-vis, the repository formed therein.

That is to say, while the front and back panels 34 and 35 are sewn together via attachment line 36, additional attachment also occurs along vertical sides, 41, 42, and 43 in the area of the article-carrying subpanel 38 to form pockets 44, student's school supplies can be inserted for use as required.

Figure 3:
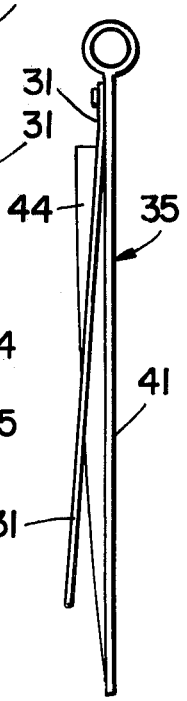
FIG. 3 is a side elevation of the stow-bag of FIG. 2.

In order to provide sufficient space to receive such items, the denim material forming the article-carrying subpanel 38 may be wider than the adjacent material forming the back panel 35. That is, before stitching along lines 41, 42 and 43, the material forming the front panel 34 may be slakened so that bulky items of the student can be accommodated within pockets 44 of the bag as shown in FIG. 3.

Note in FIG. 2 that the rod 39 is much longer than the top fold line 32. If rod 39 has a distance dimension of $D_1$ and the foldline 33 a distance dimension of $D_2$, then $D_1$ is greater than $D_2$; i.e., $$D_1 > D_2 \quad (1)$$

Also, assuming the student wants to have his bag hang from against the side of the chair, the length of fold line 32 should also be shorter than the span distance between the rear back brace post 9a and the front support column 15 of the forward leg 7c of the desk-chair 5 (FIG. 1); i.e., if the span distance between the back brace post 9a and the upright column support 7c and $D$ then the following equation occurs, $D_1$ greater than $D$ greater than $D_2$ where $D$. $D_1$ and $D_2$ are as defined above. i.e., $$D_1 > D > D_2 \quad (2)$$

Length of the strap 31 is not of great importance. Its length should be sufficient to allow the student to carry the stow-bag 30 suspended from the shoulder without touching the ground whereby the student can carry the bag (and school supplies) from class to class, home to class, etc, comfortably. Ends 46 of the strap 31 (FIG. 2) are seen to attach the bag-carrying subpanel 37 adjacent to first foldline 32. Result: a low-cost bag for storing of a student's school articles is provided but one which is easily transferable by younger students, say 4–14 years of age, from class to class or home to class without the need to disassemble the bag 30 or remove contents from pockets 44 of the subpanel 38 (FIGS. 2).

While the certain preferred embodiments of the invention have been specifically disclosed above, it should be understood that the invention is not limited thereto as many variations will be readily apparent to those skilled in the art and thus the invention is to be given the broadest possible interpretation within the terms of the following claims.

What is claimed is:

1. A storage bag for student school articles for use in conjunction with a chair-desk including a chair having a seat and back and a desk including a planar writing surface attached to an upright column support near a front edge of said seat, said column support being coplanar with a vertical back bracing post member extending above a back edge of said seat and attaching to a supportive of said chair back, but separated from said column support by a distance D, comprising a double fold of material such as denim or the like having first and second foldlines at top and bottom horizontal edges thereof so as to divide said bag into a front panel and a back panel, and a horizontal attachment line near said top foldline for permanently attaching said front to said back panel, said attachment line also dividing said front panel into a bag-carrying subpanel above said attachment line and an article carrying stowage subpanel therebelow;

said carrying subpanel being horizontally closed by said first foldline and said attachment line but open along verticle sides thereof, to form a receptacle;

and a rod means positioned over its central portion within said receptacle of said carrying subpanel and having protruding, unobstructed, free ends, for engaging said column support of said desk and said bracing member of said chair;

said article carrying subpanel being open at its top in the vicinity of said attachment line but closed along its vertical edges as well as along said bottom foldline to form an article stowage section for said school articles.

2. A storage bag for student school articles for use in conjunction with a chair-desk including a chair having a seat and back and a desk including a planar writing surface attached to an upright column support near a front edge of said seat, said column support being coplanar with a vertical back bracing post member extending above a back edge of said seat and attaching to and supportive of said chair back, but separated from said column support by a distance D, comprising a double fold of material such as denim or the like having first and second foldlines at top and bottom horizontal edges thereof so as to divide bag into a front panel and a back panel, and a horizontal attachment line near said first foldline for permanently attaching said front panel to said back panel;

said attachment line dividing said front panel into a school article subpanel below said line and a bag-carrying subpanel above said line;

said article subpanel being open at its top in the vicinity of said attachment line but closed along vertical side edges as well as along said second bottom foldline to form a stowage section for said school articles;

said bag-carrying subpanel being horizontal closed by said first top foldline and said attachment line, but open along vertical side edges to provide a repository having a horizontal axis of symmetry, and;

a rod-like means positioned within said respository having protruding, unobstructed, free ends, for engaging with said upright column support for said desk and with said vertical bracing member for said chair whereby said bag can be suspended therebetween as well as provide easy access to said stowage section by a student seated at said chair desk.

3. The bag of claim 2 in which the first top foldline has a dimension $D_2$ and said rod means has length dimension $D_1$ wherein $$D_1 > D > D_2$$

where $D$ is the horizontal distance between said upright column support for said desk and said vertical bracing member for said chair.

4. The bag of claim 2 with the addition of an elongated strap having ends attached to said bag-carrying subpanel and being of sufficient length to allow said bag to be supported from a student's shoulder when not attached to said chair-desk whereby said student can easily carry said bag from class to class, home to class or the like.

5. The bag of claim 1 in which the first top foldline has a dimension $D_2$, and said rod means has a length dimension $D_1$ wherein $$D_1 > D > D_2$$

where $D$ is the horizontal distance between said upright column support for said desk and said vertical bracing member for said chair.

6. The bag of claim 1 with the addition of an elongated strap having ends attached to said bag-carrying subpanel and being of sufficient length to allow said bag to be supported from a student's shoulder when not attached to said chair-desk whereby said student can easily carry said bag from class to class, home to class or the like, as required.

* * * * *